US012459617B2

(12) United States Patent
Davies

(10) Patent No.: US 12,459,617 B2
(45) Date of Patent: Nov. 4, 2025

(54) WATER JET PROPULSION UNIT FOR WATER BORNE CRAFT

(71) Applicant: Richard Davies, Dunedin (NZ)

(72) Inventor: Richard Davies, Dunedin (NZ)

(73) Assignee: Richard Davies, Dunedin (NZ)

( * ) Notice: Subject to any disclaimer, the term of this patent is extended or adjusted under 35 U.S.C. 154(b) by 22 days.

(21) Appl. No.: 18/569,932

(22) PCT Filed: Jul. 26, 2023

(86) PCT No.: PCT/NZ2023/050071

§ 371 (c)(1),
(2) Date: Dec. 13, 2023

(87) PCT Pub. No.: WO2024/109064

PCT Pub. Date: May 23, 2024

(65) Prior Publication Data

US 2025/0033751 A1 Jan. 30, 2025

(30) Foreign Application Priority Data

Nov. 15, 2022 (NZ) ..... 794455

(51) Int. Cl.

| | |
|---|---|
| ***B63H 11/08*** | (2006.01) |
| ***B63H 11/01*** | (2006.01) |
| ***B63H 23/06*** | (2006.01) |

(52) U.S. Cl.

CPC ..... *B63H 11/08* (2013.01); *B63H 11/01* (2013.01); *B63H 23/06* (2013.01)

(58) Field of Classification Search

CPC ..... B63H 11/08; B63H 11/01; B63H 23/06
See application file for complete search history.

(56) References Cited

U.S. PATENT DOCUMENTS

| | | | | |
|---|---|---|---|---|
| 3,082,732 | A | 3/1963 | Stallman | |
| 3,368,420 | A | 2/1968 | Alexander, Jr. | |
| 4,281,996 | A | 8/1981 | Mouraret | |
| 5,769,674 | A | 6/1998 | Stallman | |
| 6,267,632 | B1 * | 7/2001 | Blanchard | B63H 11/08 440/38 |
| 6,776,674 | B2 | 8/2004 | Blanchard | |
| 11,097,821 | B1 | 8/2021 | Schultz | |
| 2002/0081917 | A1 | 6/2002 | Roycroft | |
| 2013/0157530 | A1 * | 6/2013 | Davies | B63H 11/107 440/40 |
| 2019/0061899 | A1 * | 2/2019 | Small | B63H 23/06 |

FOREIGN PATENT DOCUMENTS

| | | |
|---|---|---|
| CA | 2698429 | 10/2010 |
| WO | WO2013/006064 | 1/2013 |

* cited by examiner

*Primary Examiner* — Stephen P Avila

(57) ABSTRACT

A mixed flow water jet pump used for propulsion in boats and other water borne craft. The jet pump may be a fixed assembly or alternatively in part comprise an intake section and flexible intake section extension allowing a trimming function and where the primary input drive shaft does not pass through the intake section of the jet pump. The jet pump drive may comprise a dual or single input drive shaft system where the dual input drive train allows for much greater power delivery to the pump while maintaining reliability. The jet pump may have a sterndrive or outboard configuration using internal combustion engines or electric motors as the primary driving means.

7 Claims, 8 Drawing Sheets

WATER JET PROPULSION UNIT FOR WATER BORNE CRAFT

FIELD OF THE INVENTION

This invention generally relates to water jet propulsion devices used for propelling boats and other water borne vehicles.

BACKGROUND OF THE INVENTION

In Canadian patent 2,698,429 (Davies) is described a water-jet propulsion pump that may be constructed as an outboard driven configuration, where the outboard powerhead is externally fixed to the watercraft's transom or alternatively as a sterndrive arrangement where the attachment of a bevel gear right-angle drive permits the driving engine to be installed inside the water craft. Also described are a number of previously patented machines that have not succeeded commercially due to poor efficiency as well as failing to meet basic functionality issues such as trim and serviceability. A previously patented outboard design, U.S. Pat. No. 3,082,732 (Stallman), describing a centrifugal pump fixed to a powerhead, is still available commercially. This jet pump fulfils many of the practical requirements demanded by customers but lacks the efficiency needed for a wider application to larger water borne craft. This device has a steering and trimming ability and is stern mounted as an outboard configuration. In U.S. Pat. No. 5,769,674 (Stallman) is described another outboard mounted jet pump but in this instance, it is of an axial flow configuration that in part resembles a section of an outboard lower leg inserted into an outer casing. The problem with this device is that the structures upstream of the flow reduce its overall efficiency to the point where it is commercially unacceptable and thus has no current market presence. In U.S. Pat. No. 4,281,996 (Mouraret) is shown a simple outboard jet pump design with a geared section inside the flow path where the vertical drive shaft penetrates through to the driving gears downstream of the stator section. The patent fails to address the hydrodynamic requirements associated with this type of arrangement and when in a tilted position the intake, which is fixed to the main centre section swivels away from the transom with the entire section. In this position multiple directional changes are seen in the flow path and the jet nozzle is elevated well above water level when the boat is in planing mode, resulting in unnecessary head loss to the pump. A jet pump described in U.S. Pat. No. 6,267,632 B1 (Blanchard) has many features required by the market but fails to address the primary issue being that of pump efficiency, particularly in respect of the stator design, as seen in the above referred to Canadian patent. U.S. Pat. No. 6,776,674 B2 (Blanchard) attempts to improve on the efficiency of the outboard jet pump concept but it is essentially a conventional axial flow jet pump fixed by a single swivel to the boat transom. This concept lacks the compactness of a conventional outboard propeller system which incorporates both a trimming and steering function. Further its primary input drive shaft is located inside the intake section flow path. In the following are described additional improvements that allow for more reliable and higher power inputs over that previously described, including a more simplified trim system. Further described is the use of a mixed flow impeller being an improvement due to more efficient recovery of radially induced energy and a means of better control of the flow through the intake section. This is achieved by the ability to calibrate the jet pump by adjusting the ratio of the impeller inlet area to that of its downstream outlet area. This provides a means of designing for the flow delivered from the intake section, that involves reducing the upstream diameter of the impeller and thereby also the size or sectional area of the intake section outlet itself. The size of the intake section is reduced and thus its encroachment on inboard space, along with a reduction in the volume of entrained water therein while the watercraft is in planing mode. This apparently simple change means that the impeller geometry, in respect of the pitch particularly, can be more beneficially configured permitting larger variations in pitch between the leading and trailing edges of the impeller where the upstream diameter of the impeller is reduced over that of its downstream end. The mixed flow design principle is currently exploited by jet pump manufacturers but where instead the primary input drive shaft is inserted axially through the intake section. In the Canadian patent is shown a single vertically arranged drive shaft passing through the stator section of the jet pump where its diameter is necessarily restricted. This is in part due to the need to keep the stator blade through which the shaft passes as thin as possible, while maintaining a hydrodynamically suitable geometry. This restriction thus effects both the hydrodynamics of the flow through the pump and the power or torque that can be safely applied to the shaft. To overcome these two issues is shown two vertical and oppositely spinning input driving shafts, interconnected by two meshed gears where both shafts pass through the same single stator blade. Bevel gears being fixed to their lower ends as seen in FIG. 1. These two input shafts thus each accept approximately 50% of the power delivered by the driving engine thereby permitting an increased power input while maintaining the overall width of the stator blade without introducing additional hydrodynamic losses. The use of the dual shaft improvement allows higher power inputs and thus use in larger vessels. For example, the jet pump seen in FIG. 3 could be constructed to attach as an outboard unit to the stern of say a commercial 30 metre planing craft using a gas turbine as its powerhead or a large electric motor. In respect of the jet pump seen in FIG. 1 is shown how the pump's efficiency can be improved by modifying the impeller housing and impeller so that they are of a "mixed flow" geometry being that the impeller has a tapered perimeter that is matched by the geometry of the outer casing or impeller housing. In a further improvement the impeller housing has two mounting pins that locate inside two pivotable mounting points located inside two transom wall recesses. A third attachment is provided by a ram fixed to the right-angle drive and the transom. A flexible sleeve connects the intake section to the impeller housing, permitting the impeller housing/gearbox-stator section assembly to thus rotate up and down independent of the intake housing. Removal of one of the sleeve retaining clamps, slot locking plate and ram connection, permits the removal of the entire impeller housing/gearbox-stator section assembly and powerhead as one unit for maintenance purposes. This arrangement, seen in FIG. 8, allows an efficient trim system but does not permit the steering ability seen in the above Canadian patent. An electric or hydraulic ram fixed to the transom, right-angle gearbox or outboard leg casing can be remotely activated allowing rotation of the entire assembly independent of the intake section thus facilitating trimming of the water craft. Thrust is directed to the transom rather than the intake, which, significantly, means that with the intake no longer receiving thrust it may be of much lighter construction. Also addressed is the problem of entrainment of debris in the intake grill by providing a simple relatively loss free intake cleaning system where the intake cleaning mechanism is placed so as to be out of the intake flow path. The concept of an intake cleaning system is not new and such a system is currently already used in the market where the cleaning bars are mounted to the intake grill itself. An example of an intake cleaning system is described in U.S. Pat. No. 11,097,821 B1 (Schultz) where a set of interconnected grill cleaning bars may be lowered down through the fixed intake grill bars fixed to a "Stallman" outboard style centrifugal jet pump. The cleaning bars are set in between the fixed bars when not activated and so are still placed inside the main intake flow but none the less providing a solution to grill fouling. The difference in the present case being that the cleaning blades are outside of the intake section flow which is not satisfactorily achieved in jet pumps that have an axially placed shaft or in the above example of a grill cleaning system for a Stallman style centrifugal outboard jet pump.

SUMMARY OF THE INVENTION

The present invention is directed at further improving jet pump efficiency and allowing greater power inputs than that described in the above referred to Canadian patent while retaining the advantages of serviceability and ease of attachment to any watercraft. In order to provide an increased power input a dual input shaft system is described where the primary drive train is split in two where the impeller shaft is driven by two bevel gear sets that each drive in the same direction. This is achieved without unduly increasing any hydrodynamic loss by passing two vertical shafts through a single modified stator blade thus still retaining the right-angle drive and outboard formats. In a further variant is described a double vertical shaft solution where the ability for a higher power input is lessened but allows for a change in the impeller drive shaft speed by permitting the ratio of two paired gears to be changed. This means that one can alter the primary drive input gear ratio without the need to change the impeller drive shaft bevel gear ratios. Importantly this feature thus allows maximised gear sizing of the impeller drive shaft bevel gears without, for example, the need for a smaller and less load bearing bevel pinion with less teeth. In respect of pump efficiency also addressed is the use of a mixed flow geometry for the impeller and impeller housing. This concept is again not new but in this context where there is no primary axial drive input shaft in the intake section of the jet pump, it is possible to use a mixed flow geometry to greater effect. This arises because the leading edges of the impeller can be extended to the very upstream tip of the impeller boss. This ability allows one to more easily calibrate the incoming upstream flow by having greater freedom to adjust impeller diameter and impeller blade leading edge position. One of the main disadvantages of jet pumps over propeller drives such as outboards is the risk of intake section blockage. This issue was traditionally overcome somewhat by the insertion of fixed grill bars in the intake section. Having been proved ineffective in dealing with water borne weeds a drop-down through grill cleaning bar solution was adopted by many manufacturers but this had some limitations due to the presence of the axial shaft in the intake section. The absence of an axial shaft through the intake section in this invention thus allows for the installation of a drop-down cleaning screen that has an activation lever or plunger fixed centrally to a swinging grill that has no drive shaft interference. In the retracted position the grill bars or fingers are located inside individual recesses cast into the intake section roof. This provides a relatively smooth surface as the bars are removed entirely from the incoming flow.

In the below described machines currently manufactured nozzle steering and deflector based reversing systems are excluded in order to simplify the description of each device.

In summary the following are addressed:

(i) Ability to increase power input loads using a more robust drive train while maintaining pump efficiency.
(ii) Improvement of pump efficiency and input flow rate by the use of a mixed flow geometry for the impeller and impeller housing.
(iii) Ability to alter the impeller drive speed without changing bevel gears.
(iv) Simplified trimming system.
(v) Provision of an improved intake grill cleaning system.

DETAILED DESCRIPTION OF PREFERRED EMBODIMENTS

Figure 1:
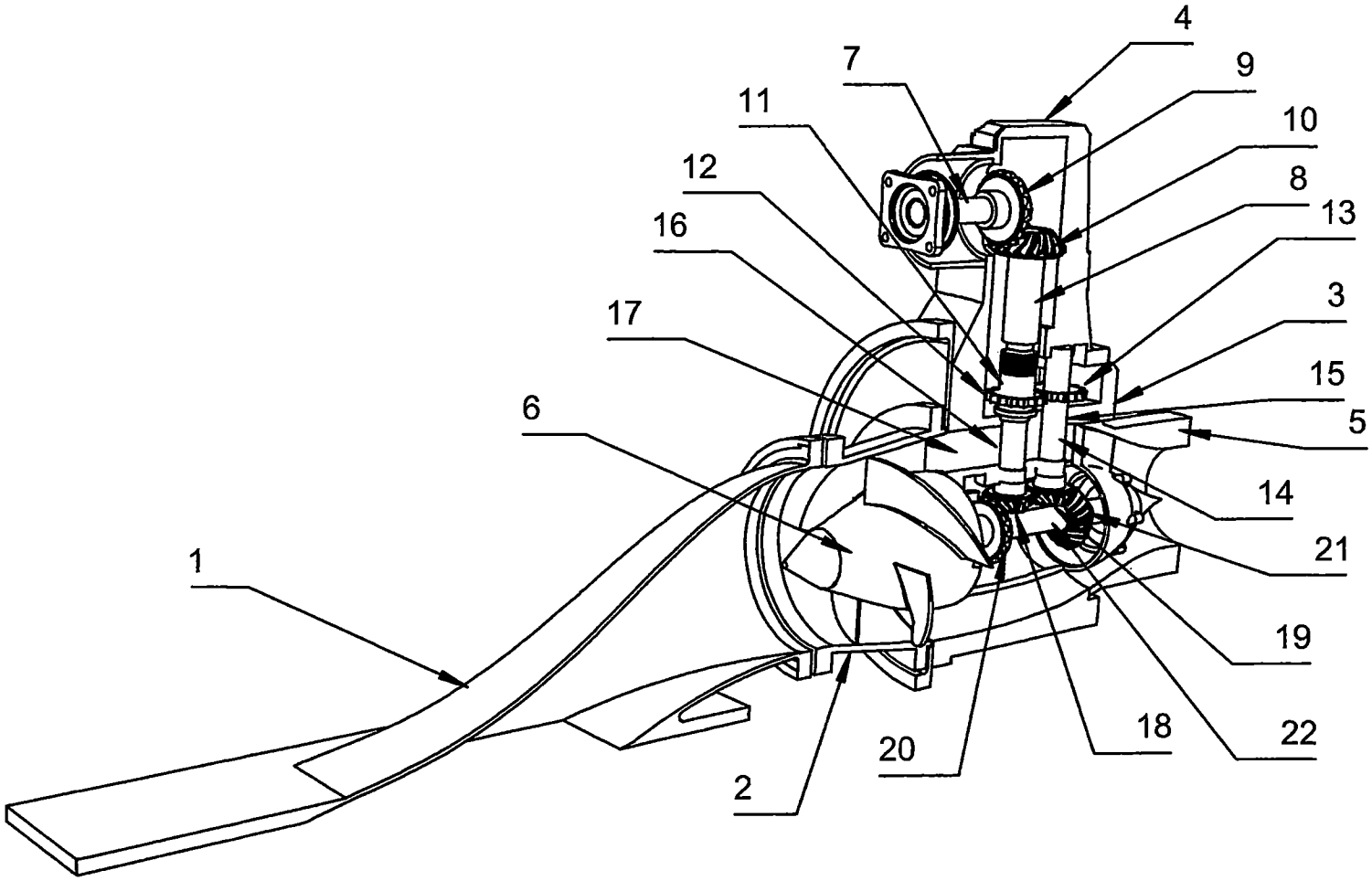
FIG. 1: An isometric cut away view of a mixed flow stern drive version of the jet pump showing the right-angle drive, single mixed flow impeller, a dual shaft input configuration comprising a primary input shaft, where the input power is shared by an additional shaft via two meshed gears and where both shafts pass vertically through the modified stator blade as shown in FIG. 6. The two shafts in turn drive the four interconnected bevel gears mounted inside the gearbox casing where they together cause the impeller shaft to rotate under their combined input torques.
Figure 6:
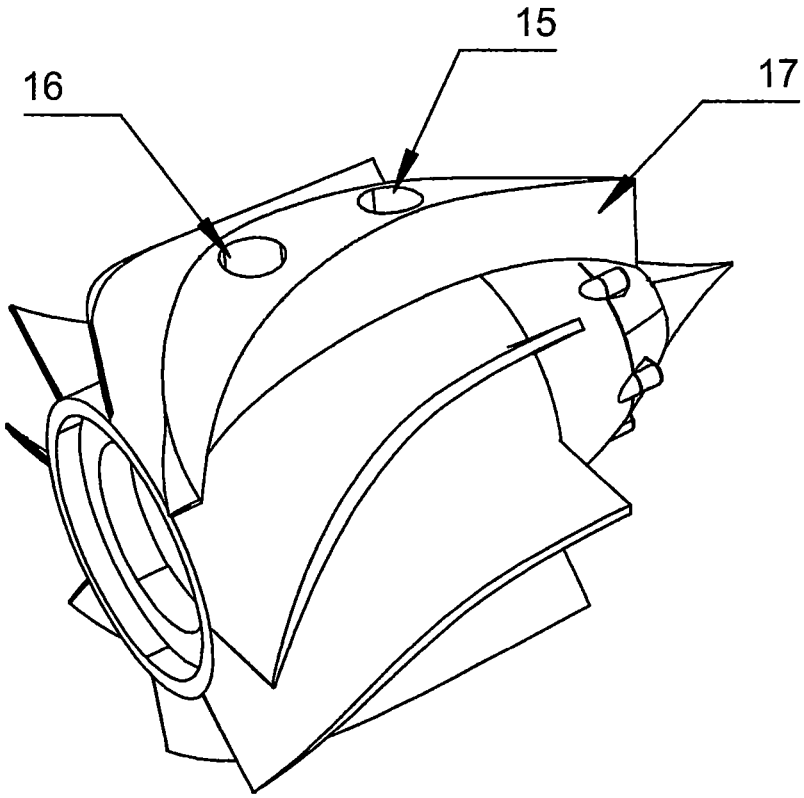
FIG. 6: A cutaway isometric view of the jet pump stator showing the modified stator blade and the two vertical holes that allow for the two vertical input drive shafts to pass through into the lower gear case.

In FIG. 1 is shown a mixed flow jet pump having an intake section (1) with a tapered impeller housing (2) directly fixed to its downstream end. Further fixed to the impeller housing (2) is the stator-gearbox section (3) right-angle drive (4) fixed to its upper portion and a nozzle (5). A mixed flow impeller (6) is shown located inside the impeller housing (2). The jet pump has a primary input drive shaft (7) connected to the vertical drive shaft (8) via bevel gears (9) and (10). The vertical shaft (8) is connected to the lower vertical shaft (11) via mating splines (not shown) and where the lower vertical shaft (11) has a gear (12) fixed to it, that meshes with the gear (13) that is fixed to the lower vertical shaft (14). Vertical shafts (11) and (14) each pass through holes (15) and (16) shown in the modified stator blade (17) seen more clearly in FIG. 6. Shafts (11) and (14) have bevel gears (18) and (19) fixed to their lower ends, bevel gears (18) and (19) being in mesh with bevel gears (20) and (21). The gears (20) and (21) are fixed to the impeller shaft (22) and are jointly driven to rotate the shaft (22) in the same direction. This gear train thus allows an increased level of power input to be applied to the jet pump.

Figure 2:
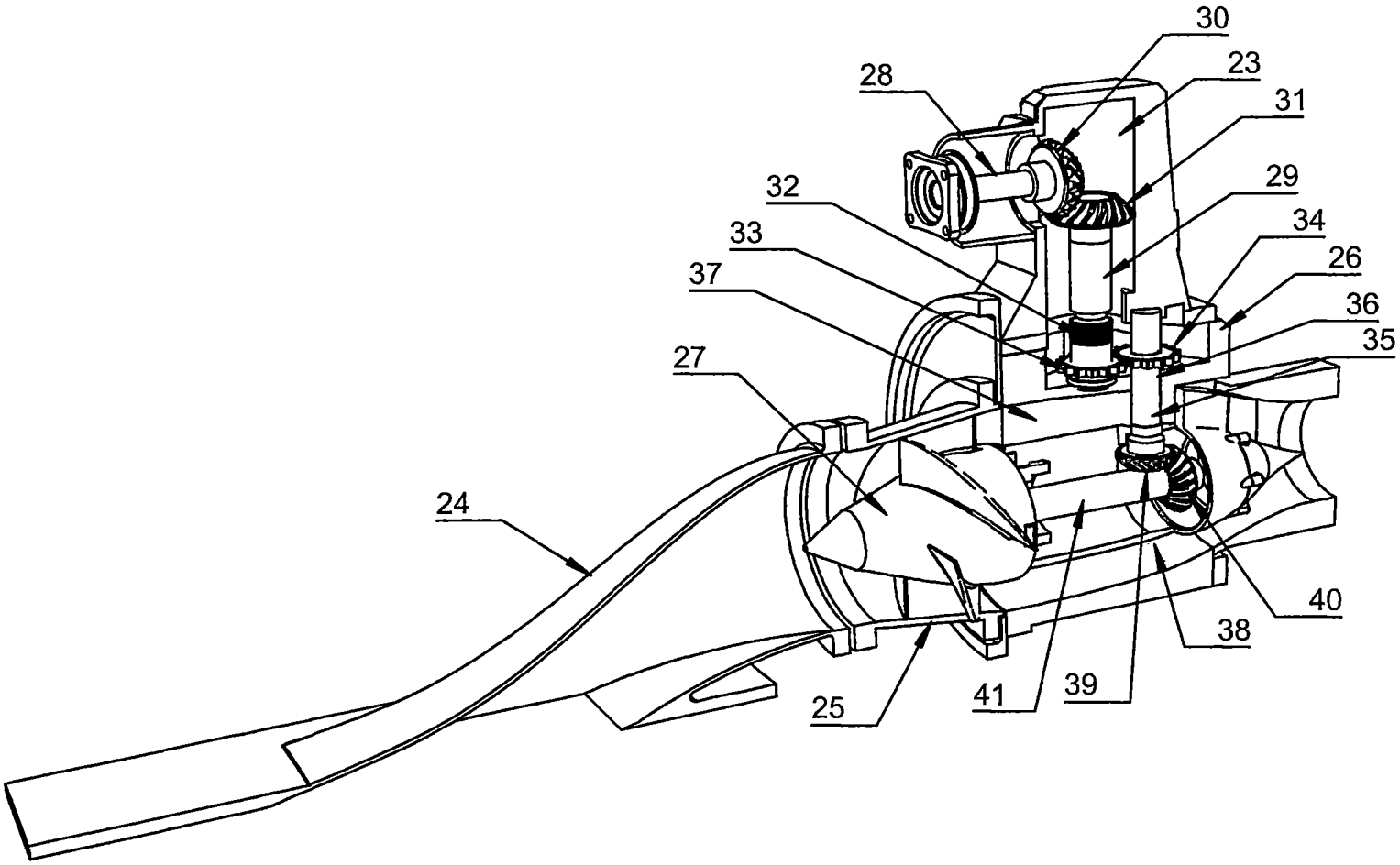
FIG. 2: An isometric cut away view of a mixed flow stern drive version of the jet pump showing the right-angle drive, single mixed flow impeller, where the gear train comprises a vertical input shaft with a gear fixed to its lower end, this gear being in mesh with a second gear, permitting a gear ratio change if required, the second gear being fixed to a second adjacent vertical shaft that passes vertically down through a modified stator blade, seen in FIG. 7, a bevel gear being fixed to its lower end that meshes with a second bevel gear fixed to the impeller drive shaft.
Figure 7:
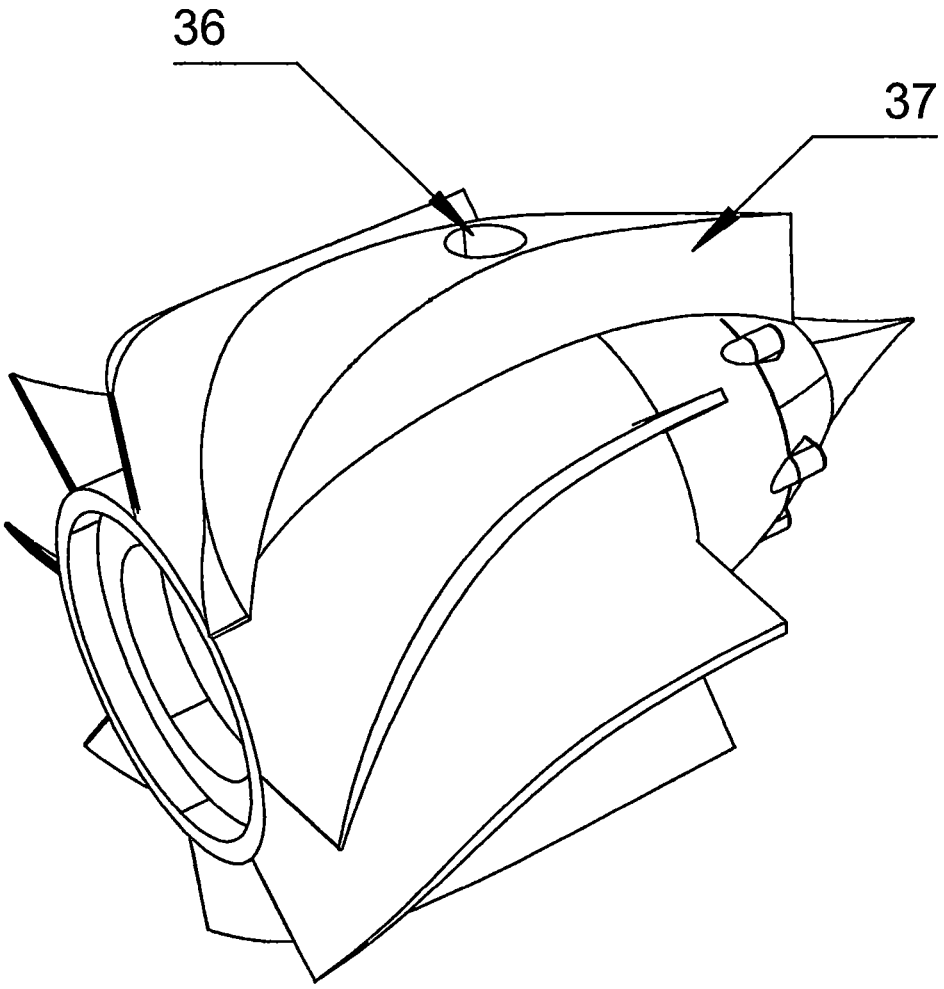
FIG. 7: A cutaway isometric view of the jet pump stator showing the modified stator blade with one vertical hole that allows for one vertical input shaft to pass through into the lower gear case.

In FIG. 2 is shown a similar jet pump having a top mounted right-angle drive input (23) but with a different gear train arrangement. This mixed flow jet pump has an intake section (24) with a tapered impeller housing (25) directly fixed to its downstream end. Further fixed to the impeller housing (25) is the stator-gearbox section (26) and right-angle drive input (23) fixed to its upper portion. A mixed flow impeller (27) is shown located inside the impeller housing (25). The jet pump has a primary input drive shaft (28) connected to the vertical drive shaft (29) via bevel gears (30) and (31). The vertical shaft (29) is connected to the shortened lower vertical shaft (32) via mating splines (not shown) and where the lower vertical shaft (32) has a gear (33) fixed to it that meshes with the gear (34), that is fixed to a second lower vertical shaft (35). The gears (33) and (34) may have their combined ratio altered so that the rpm of the impeller drive shaft (41) can be changed as required. The shaft (35) passes through a single hole (36), (Seen more clearly in FIG. 7), in the modified stator blade (37), into the lower gear case (38). A bevel gear (39) fixed to the lower end of the shaft (35) meshes with a bevel gear (40) fixed to the impeller drive shaft (41).

Figure 3:
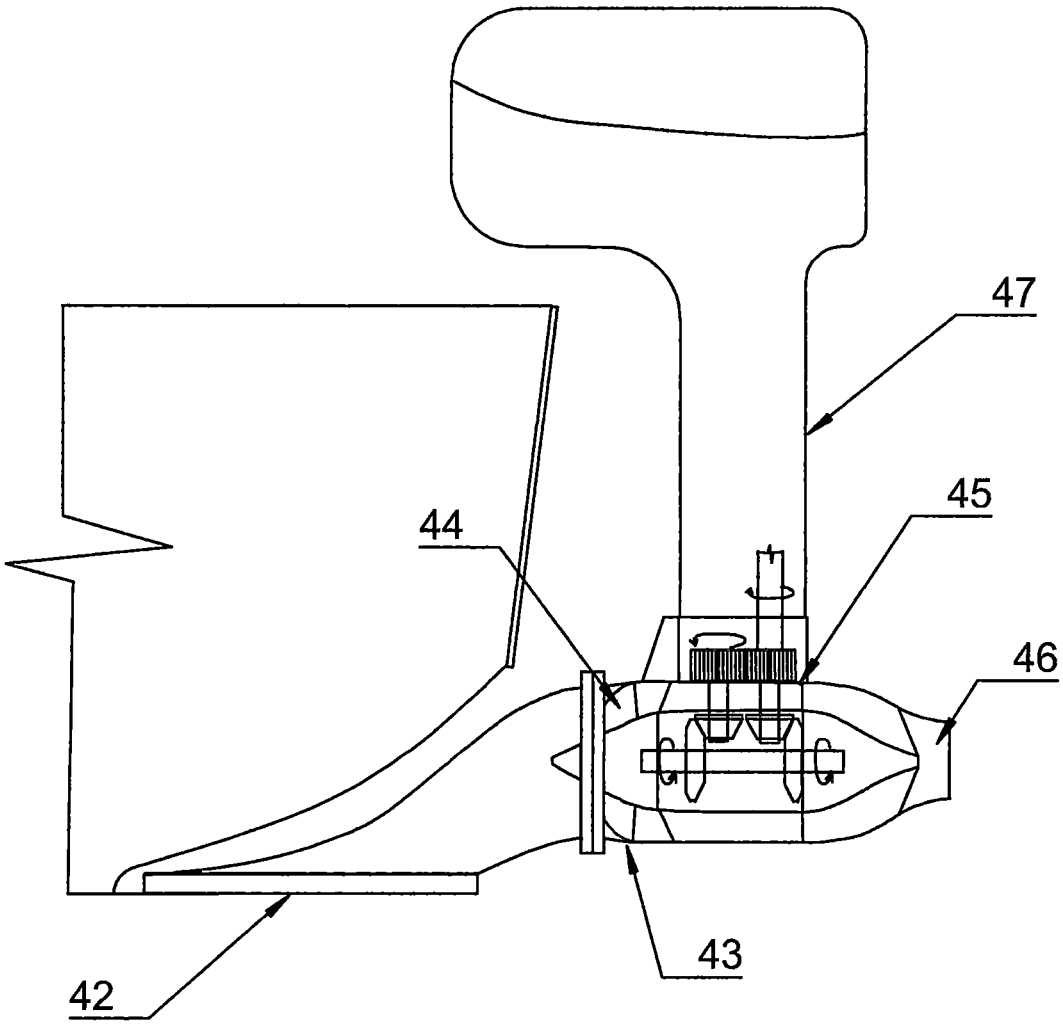
FIG. 3: Side elevation of a mixed flow outboard jet pump having a single mixed flow impeller, a dual shaft input configuration comprising a primary input shaft, where the input power is shared by an additional shaft via two meshed gears and where both shafts pass vertically through the modified stator blade as shown in FIG. 6. The two shafts in turn drive the four interconnected bevel gears mounted inside the gearbox casing where they together cause the impeller shaft to rotate under their combined input torques. Also shown is a method of jet pump articulation in the vertical plane, allowing the impeller housing/gearbox-stator section assembly to rotate up and down, thus allowing the craft to be trimmed while in planing mode.

In FIG. 3 is shown a mixed flow outboard jet pump being a dual shaft input configuration comprising an intake section (42), impeller housing (43), a single mixed flow impeller (44), stator-gearbox section (45), nozzle (46) and outboard powerhead (47). The drive train is otherwise identical to that shown in FIG. 1.

Figure 4:
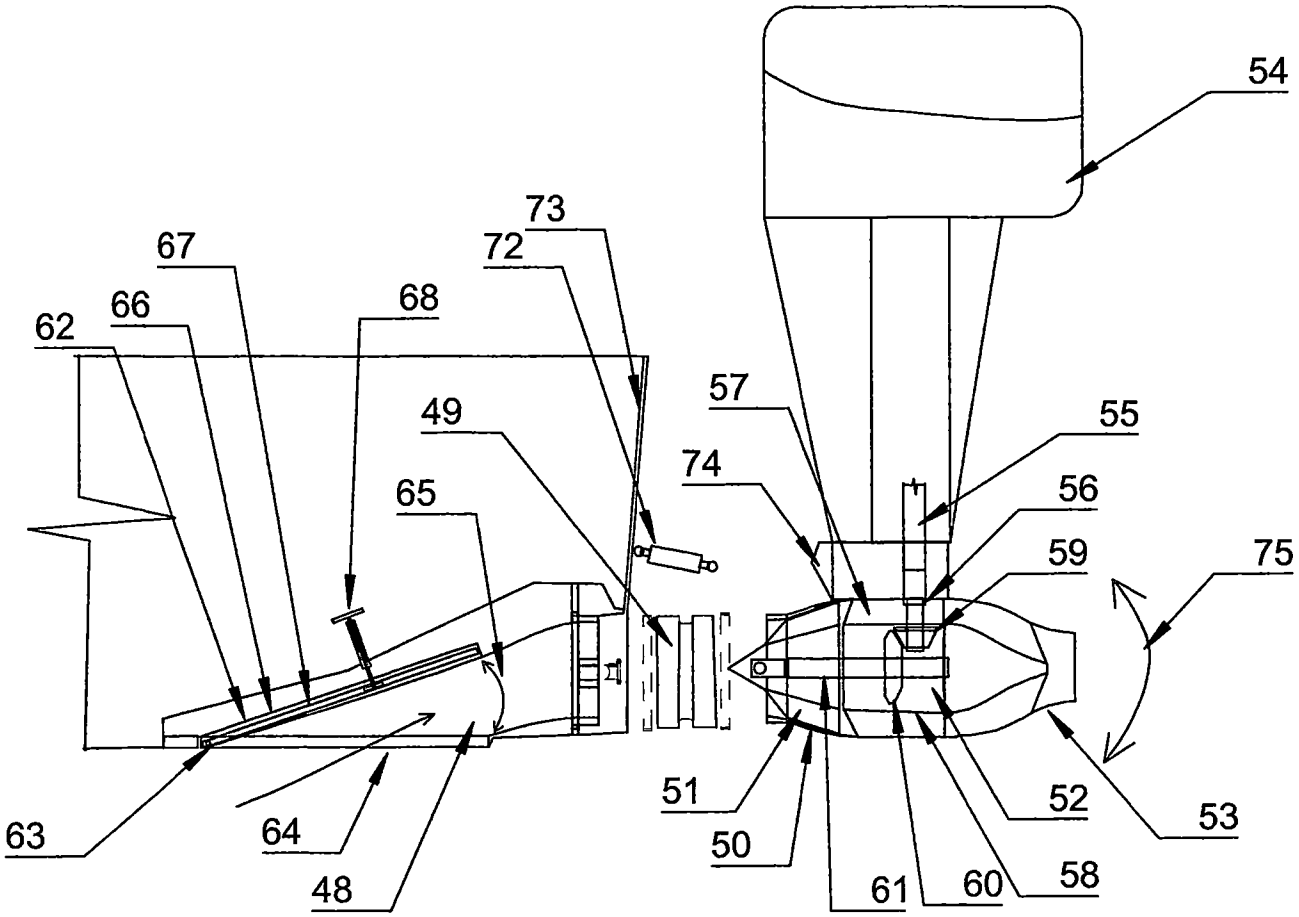
FIG. 4: Side elevation of a mixed flow outboard jet pump having a single mixed flow impeller showing the major components separated. Also shown is an intake that contains a pivoting grill cleaning device comprising bars that lower down between the fixed intake section grill bars but that retract into a recess located in the upstream roof of the intake section so that hydrodynamic losses are minimised.

In FIG. 4 is shown a mixed flow outboard jet pump having a simpler drive train with fewer gears but in this instance also incorporating a trimming means that permits the nozzle (53) to be moved up and down relative to the intake section (48) and a grill cleaning system. Its main components are shown separated for clarity. The jet pump comprises an intake section (48), flexible sleeve (49), impeller housing (50), mixed flow impeller (51), stator-gearbox section (52), nozzle (53), and outboard powerhead (54). There is a single primary input shaft (55) used to transmit power to the stator-gearbox section (52). The shaft (55) passes through a single hole (56) in the modified stator blade (57), seen also in FIGS. 7, as (36) and (37), into the lower gearbox casing (58), the shaft (55) having a bevel gear (59) fixed to its lower end that meshes with the bevel gear (60) fixed to the impeller shaft (61).

Figure 5:
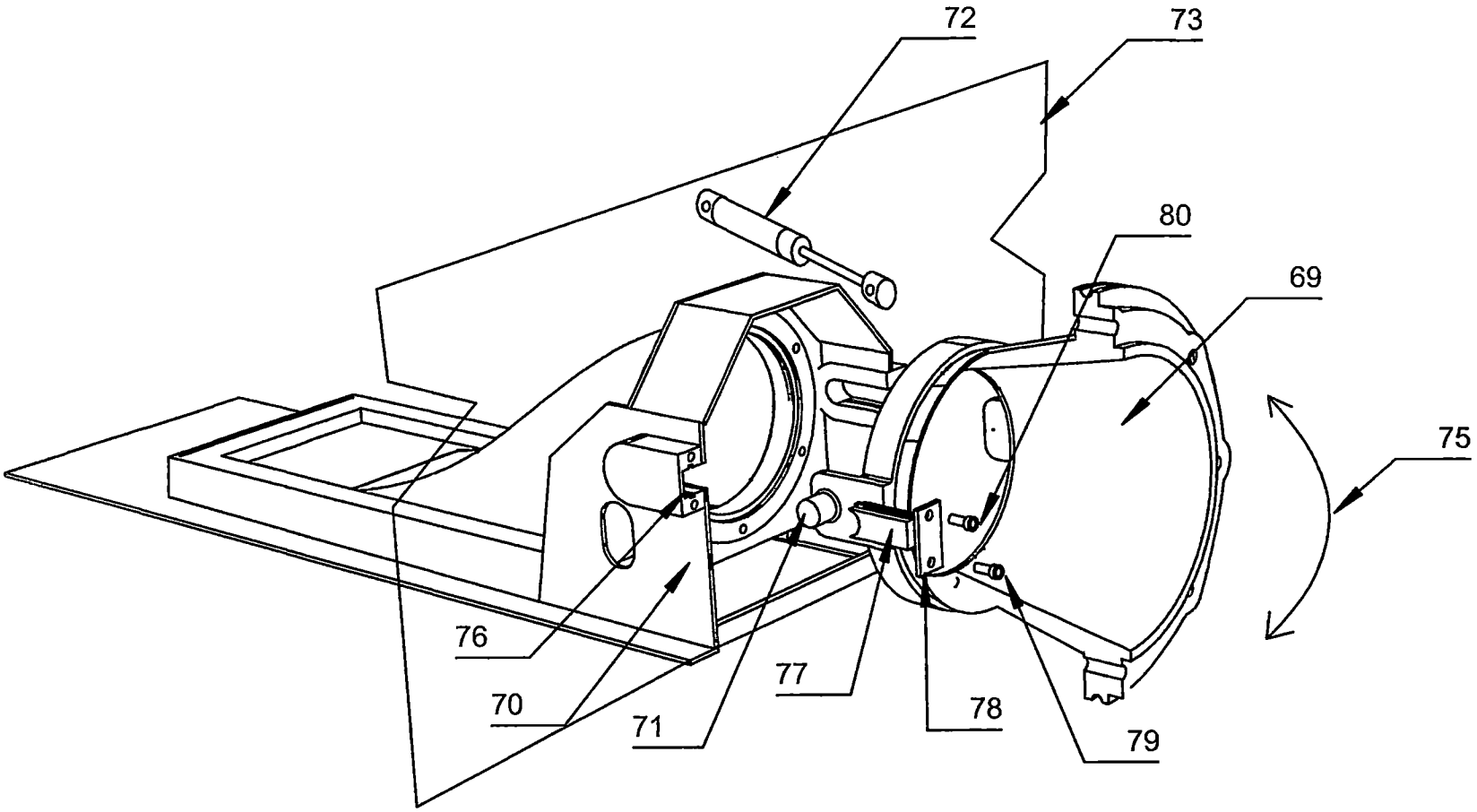
FIG. 5: An isometric cutaway view of the jet pump showing the mixed flow impeller housing, intake section and pivot arrangement that allows the impeller housing/gearbox-stator section to rotate up and down independent of the intake section.
Figure 8:
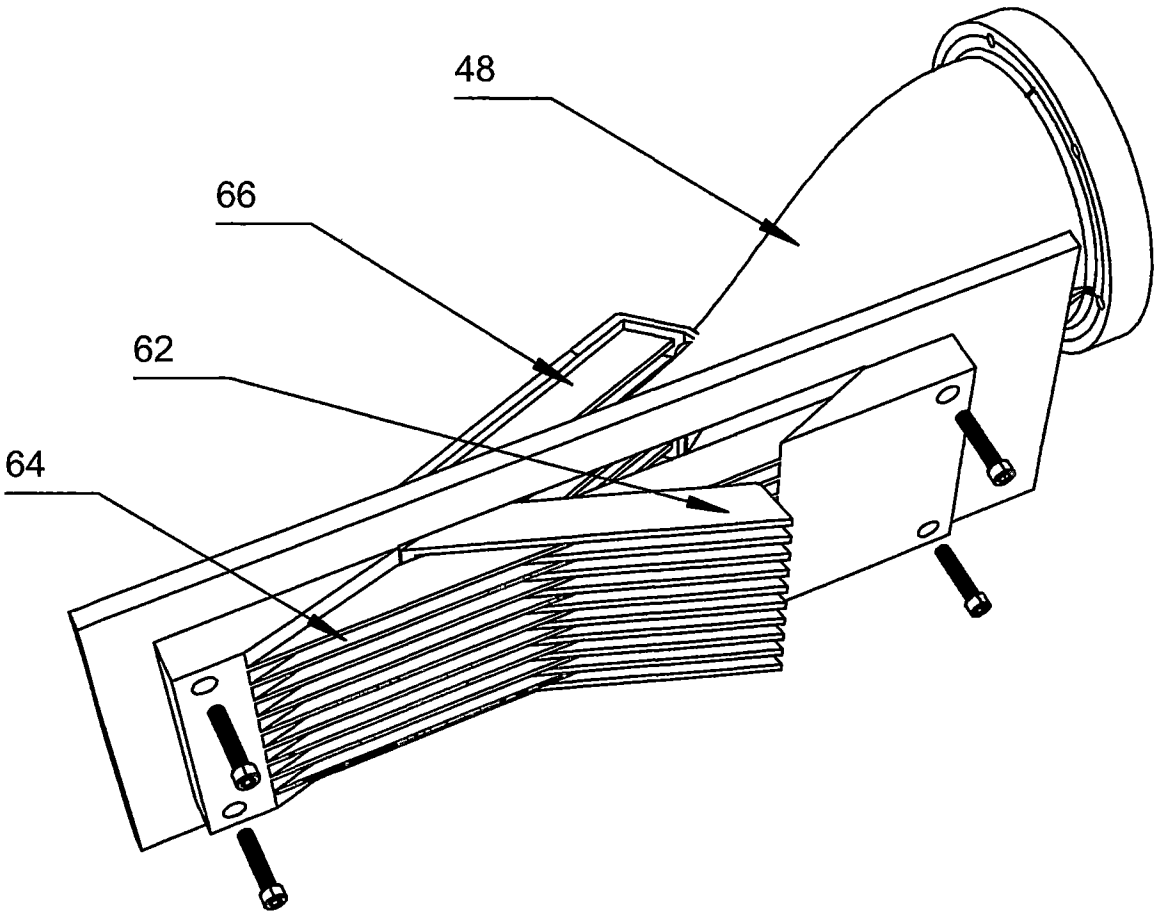
FIG. 8: A view of the jet pump intake section and intake grill showing a means of removing debris from between the fixed intake grill bars.

Also shown in FIG. 4 a retractable grill cleaning system, seen also in FIG. 8, whereby a series of spaced grill bar fingers (62) are fixed by a hinge (63) at the upstream end of the fixed intake grill (64) that swing (65) down and between the fixed intake grill (64) from a recess (66) in the upper roof (67) of the intake section (48). A plunging rod (68) enables manual or remote activation of the bar fingers (62). This permits the removal of weeds and other debris from the intake grill (64). A drop-down intake grill cleaning system is currently in commercial use but in jet pumps with through-intake drive shafts the hinged grill is fixed to the underside of the fixed intake grill. When activated the hinged grill swivels down from between the fixed grill bars to below the keel line displacing any debris. In this arrangement however, the provision of the recess (66) places the bar fingers (62) outside of the intake flow path when not in use. Further the centred position of the rod (68) is permissible because there is no axial drive shaft present. In the isometric sectional view FIG. 5 is shown a more detailed view of the trimming means seen in FIG. 4. In FIG. 5 is the attachment means where the impeller housing (69), is mounted independently to the transom housing (70) via pivot pin (71) and a second pin (not visible) allowing the pumps output thrust to be transferred to the transom housing (70). A ram (72), seen also in FIG. 4, is fixed to the transom (73) and the upper gear case (74) seen in FIG. 4, thereby allowing remote control of up and down movement (75), FIG. 5, also seen FIG. 4 (65). The pivot pin (71) and its partner (not shown) are secured by insertion into the keyed slot(s) (76) and the retention fixture (77), locking plate (78) and bolts (79) and (80)

What is claimed:

1. A mixed flow water jet pump comprising an intake section, mixed flow impeller housing, mixed flow impeller, stator-gearbox section, right-angle gearbox, a nozzle fixed to said stator-gearbox section, said right-angle gearbox and stator-gearbox section having a gear train where the said gear train comprises a primary input shaft coupled via two meshing bevel gears to a vertical input shaft, said vertical shaft being coupled via a mating spline to a lower shaft, said lower shaft having a gear fixed to its upper end that in turn meshes with a gear fixed to the upper end of an adjacent vertical lower shaft, and where both of the said lower shafts pass into the lower gear case through two holes in a single hydrodynamically modified stator blade, said lower shafts having bevel gears fixed to their lower ends, said bevel gears in turn meshing with two further bevel gears fixed to the impeller drive shaft and where both lower shafts transmit equal power or torque to the said impeller drive shaft, said intake section, mixed flow impeller housing, stator-gearbox section, nozzle and right-angle drive being fixed to one another.

2. A mixed flow water jet pump comprising an intake section, mixed flow impeller housing, mixed flow impeller, stator-gearbox section, right-angle gearbox, a nozzle fixed to said stator-gearbox section, said right-angle gearbox and stator-gearbox section having a gear train where the said gear train comprises a primary input shaft coupled via two meshing bevel gears to a vertical input shaft, said vertical shaft being coupled via a mating spline to a lower shaft, said lower shaft having a gear fixed to its upper end that in turn meshes with a gear fixed to the upper end of an adjacent vertical lower shaft, said gears being able to be substituted with gears of different ratios, said adjacent vertical shaft passing into the lower gear case through a single hole in a hydrodynamically modified stator blade, said shaft having a bevel gear fixed to its lower end, said bevel gear meshing with a bevel gear fixed to the impeller shaft, said intake section, mixed flow impeller housing, gearbox-stator section, nozzle and right-angle gearbox being fixed to one another.

3. A mixed flow water jet pump comprising an intake section, mixed flow impeller housing, mixed flow impeller, stator-gearbox section, a nozzle fixed to said stator-gearbox section, an outboard powerhead fixed to said stator-gearbox section, having a gear train where the said gear train comprises a vertical input shaft, said vertical shaft being connected to the said outboard powerhead, said vertical shaft being coupled via a mating spline to a lower shaft, said lower shaft having a gear fixed to its upper end that in turn meshes with a gear fixed to the upper end of an adjacent vertical lower shaft, and where both of the said lower shafts pass into the lower gear case through two holes in a single hydrodynamically modified stator blade, said lower shafts having bevel gears fixed to their lower ends, said bevel gears in turn meshing with two further bevel gears fixed to the impeller drive shaft and where both lower shafts transmit equal power or torque to the said impeller drive shaft, said intake section, mixed flow impeller housing, stator-gearbox section, nozzle and powerhead being fixed to each other.

4. A mixed flow water jet pump comprising an intake section, mixed flow impeller housing, mixed flow impeller, flexible sleeve fixed to said intake section and mixed flow impeller housing, stator-gearbox section, a nozzle fixed to said stator-gearbox section, an outboard powerhead fixed to the said stator-gearbox section, said outboard powerhead being connected to the stator-gearbox section via a vertical input drive shaft coupled via a mating spline to a gear train comprising a vertical lower shaft having a gear fixed to its upper end that in turn meshes with a gear fixed to the upper end of an adjacent vertical lower shaft, and where both of the said lower shafts pass into the lower gear case through two holes in a hydrodynamically modified stator blade, said lower shafts having bevel gears fixed to their lower ends, said bevel gears in turn meshing with two further bevel gears fixed to the impeller drive shaft and where both lower shafts transmit equal power or torque to the said impeller drive shaft, said mixed flow impeller housing being connected via two pivot pins and a ram to the water craft's transom, and where the said mixed flow impeller housing is fixed at its down-stream end to the said stator-gearbox section whereby the said powerhead, stator-gearbox section and mixed flow impeller housing, being jointly connected to the intake section via the flexible sleeve, pins, and ram, may be rotated up and down for trimming purposes.

5. A mixed flow water jet pump comprising an intake section, mixed flow impeller housing, mixed flow impeller, flexible sleeve attached to said intake section and mixed flow impeller housing, stator-gearbox section, right-angle gearbox, a nozzle fixed to said stator-gearbox section, a gear train comprising a primary input shaft coupled via two meshing bevel gears to a vertical input shaft, said vertical shaft being coupled via a mating spline to a lower shaft, said lower shaft having a gear fixed to its upper end that in turn meshes with a gear fixed to the upper end of an adjacent vertical lower shaft, and where both of the said lower shafts pass into the lower gear case through two holes in a single hydrodynamically modified stator blade, said lower shafts having bevel gears fixed to their lower ends, said bevel gears in turn meshing with two further bevel gears fixed to the impeller drive shaft and where both lower shafts transmit equal power or torque to the said impeller drive shaft, said mixed flow impeller housing being connected via two pivot pins and a ram to the water craft's transom and where the said right-angle gearbox, stator-gearbox section and mixed flow impeller housing, being jointly connected to the intake section via the flexible sleeve, pins and ram may be rotated up and down for trimming purposes.

6. A mixed flow water jet pump comprising an intake section, mixed flow impeller housing, mixed flow impeller, flexible sleeve attached to said intake section and mixed flow impeller housing, stator-gearbox section, a nozzle fixed to said stator-gearbox section, an outboard powerhead fixed to the said stator-gearbox section, said powerhead being connected to the stator-gearbox section via a primary vertical input shaft that is coupled via a mating spline to a gear train comprising a vertical lower shaft, said vertical shaft passing into the lower gear case through a single hole in a hydrodynamically modified stator blade, said lower vertical shaft having a bevel gear fixed to its end, said bevel gear meshing with a bevel gear fixed to the impeller drive shaft, said impeller housing being connected via two pivot pins and a ram to the water craft's transom and where the said powerhead, stator-gearbox section and mixed flow impeller housing being jointly connected to the intake section via the flexible sleeve, pins and ram may be rotated up and down for trimming purposes.

7. A mixed flow water jet as claimed in one of claims 1-6 where the intake section may include a hinged pivoting grill cleaning device that retracts into a recess in the roof of the intake section of the water jet pump.

* * * * *